US010452021B2

(12) United States Patent
Miura et al.

(10) Patent No.: US 10,452,021 B2
(45) Date of Patent: Oct. 22, 2019

(54) PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Daisuke Miura, Tokyo (JP); Shuhei Iwasaki, Yokohama (JP); Akira Sakakibara, Susono (JP); Tatsuya Yamaai, Yokohama (JP); Kazunori Noguchi, Suntou-gun (JP); Harunobu Ogaki, Suntou-gun (JP); Kazunari Hagiwara, Yokohama (JP); Yuji Kawaguchi, Inagi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/198,105

(22) Filed: Nov. 21, 2018

(65) Prior Publication Data

US 2019/0163120 A1 May 30, 2019

(30) Foreign Application Priority Data

Nov. 24, 2017 (JP) ..... 2017-226186

(51) Int. Cl.

| | |
|---|---|
| ***G03G 15/02*** | (2006.01) |
| ***G03G 21/18*** | (2006.01) |
| ***G03G 5/05*** | (2006.01) |
| ***G03G 15/00*** | (2006.01) |

(52) U.S. Cl.

CPC ..... *G03G 21/1814* (2013.01); *G03G 5/0567* (2013.01); *G03G 15/0233* (2013.01); *G03G 15/75* (2013.01)

(58) Field of Classification Search

CPC ..... G03G 5/147; G03G 5/14752; G03G 5/14756; G03G 5/14795; G03G 15/095

See application file for complete search history.

(56) References Cited

U.S. PATENT DOCUMENTS

| | | | |
|---|---|---|---|
| 5,214,208 | A | 5/1993 | Tanaka et al. |
| 6,991,881 | B2 | 1/2006 | Ogaki et al. |
| 6,994,941 | B2 | 2/2006 | Tanaka et al. |

(Continued)

FOREIGN PATENT DOCUMENTS

| | | |
|---|---|---|
| JP | 2001-075451 | 3/2001 |
| JP | 2012-053311 | 3/2012 |

OTHER PUBLICATIONS

U.S. Appl. No. 16/196,106, Shuhei Iwasaki, filed Nov. 20, 2018.
U.S. Appl. No. 16/198,008, Tatsuya Yamai, filed Nov. 21, 2018.

*Primary Examiner* — Peter L Vajda
(74) *Attorney, Agent, or Firm* — Venable LLP

(57) ABSTRACT

A process cartridge configured to be detachably attachable to a main body of an electrophotographic image forming apparatus, in which an occurrence of an image failure is suppressed, wherein the process cartridge includes an electrophotographic photosensitive member and a cleaning member arranged in contact with the electrophotographic photosensitive member, wherein an elastic deformation modulus of a surface layer of the electrophotographic photosensitive member is 35% or larger, and the cleaning member is formed of a urethane foam, wherein a density of the urethane foam is 200 to 500 kg/cm$^3$, and a 25% compressive load of the urethane foam is 0.3 MPa or smaller.

8 Claims, 1 Drawing Sheet

(56) References Cited

U.S. PATENT DOCUMENTS

| | | | |
|---|---|---|---|
| 7,001,699 | B2 | 2/2006 | Yoshida et al. |
| 7,045,261 | B2 | 5/2006 | Tanaka et al. |
| 7,413,840 | B1 | 8/2008 | Ogaki et al. |
| 7,551,878 | B2 | 6/2009 | Ogaki et al. |
| 7,622,238 | B2 | 11/2009 | Uematsu et al. |
| 7,629,102 | B2 | 12/2009 | Ochi et al. |
| 7,645,547 | B2 | 1/2010 | Okuda et al. |
| 7,655,370 | B2 | 2/2010 | Kitamura et al. |
| 7,704,657 | B2 | 4/2010 | Uesugi et al. |
| 7,718,331 | B2 | 5/2010 | Uematsu et al. |
| 7,749,667 | B2 | 7/2010 | Kawahara et al. |
| 7,838,190 | B2 | 11/2010 | Ogaki et al. |
| 7,875,410 | B2 | 1/2011 | Ogaki et al. |
| 7,927,774 | B2 | 4/2011 | Ogaki et al. |
| 7,931,848 | B2 | 4/2011 | Ochi et al. |
| 8,457,528 | B2 | 6/2013 | Ochi et al. |
| 8,669,027 | B2 | 3/2014 | Anezaki et al. |
| 8,753,789 | B2 | 6/2014 | Ogaki et al. |
| 8,815,479 | B2 | 8/2014 | Shida et al. |
| 8,846,281 | B2 | 9/2014 | Okuda et al. |
| 8,865,380 | B2 | 10/2014 | Noguchi et al. |
| 8,921,020 | B2 | 12/2014 | Murai et al. |
| 8,980,508 | B2 | 3/2015 | Okuda et al. |
| 8,980,509 | B2 | 3/2015 | Noguchi et al. |
| 9,034,545 | B2 | 5/2015 | Maruyama et al. |
| 9,114,565 | B2 | 8/2015 | Kawai et al. |
| 9,188,888 | B2 | 11/2015 | Okuda et al. |
| 9,207,550 | B2 | 12/2015 | Okuda et al. |
| 9,235,144 | B2 | 1/2016 | Yamamoto et al. |
| 9,261,811 | B2 | 2/2016 | Hagiwara et al. |
| 9,261,814 | B2 | 2/2016 | Hagiwara et al. |
| 9,274,442 | B2 | 3/2016 | Sato et al. |
| 9,280,071 | B2 | 3/2016 | Maruyama et al. |
| 9,280,072 | B2 | 3/2016 | Ogaki et al. |
| 9,282,615 | B2 | 3/2016 | Yamagishi et al. |
| 9,304,414 | B2 | 4/2016 | Miura et al. |
| 9,304,416 | B2 | 4/2016 | Noguchi et al. |
| 9,341,964 | B2 | 5/2016 | Ogaki et al. |
| 9,405,217 | B2 | 8/2016 | Tokiwa et al. |
| 9,436,107 | B2 | 9/2016 | Murakami et al. |
| 9,507,283 | B2 | 11/2016 | Maruyama et al. |
| 9,575,422 | B2 | 2/2017 | Okuda et al. |
| 9,599,917 | B2 | 3/2017 | Okuda et al. |
| 9,651,879 | B2 | 5/2017 | Maruyama et al. |
| 9,726,992 | B2 | 8/2017 | Sakuma et al. |
| 9,791,792 | B2 | 10/2017 | Miyauchi et al. |
| 9,851,646 | B2 | 12/2017 | Tomono et al. |
| 2014/0154618 | A1 | 6/2014 | Maruyama et al. |
| 2014/0212800 | A1 | 7/2014 | Miura et al. |
| 2015/0185630 | A1 | 7/2015 | Ito et al. |
| 2017/0060008 | A1 | 3/2017 | Okuda et al. |
| 2018/0059558 | A1 | 3/2018 | Ito et al. |

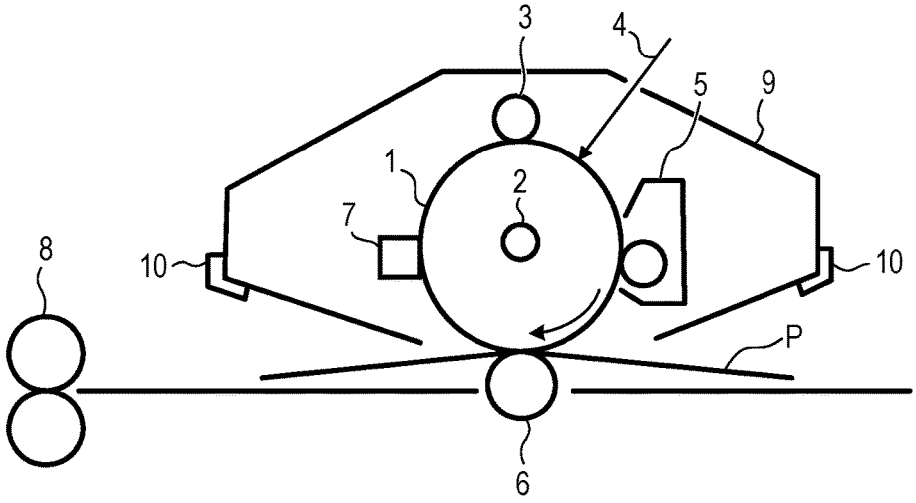
3
4
5
9
1
2
7
8
10
10
P
6

PROCESS CARTRIDGE AND ELECTROPHOTOGRAPHIC IMAGE FORMING APPARATUS

BACKGROUND OF THE INVENTION

Field of the Invention

The present invention relates to a process cartridge and an electrophotographic image forming apparatus.

Description of the Related Art

In an electrophotographic image forming apparatus and a process cartridge configured to be detachably attachable to a main body of an electrophotographic image forming apparatus, a cleaning member is provided in order to remove a discharge product adhering to and a toner remaining on an electrophotographic photosensitive member (hereinafter, photosensitive member), after a toner image has been transferred onto an object to be transferred such as paper or an intermediate transfer member, from the photosensitive member. Among these cleaning members, a cleaning blade using a reed-shaped elastic member such as polyurethane rubber is known.

It is known that this cleaning blade system is apt to cause a lowering of scrapability due to wear and chipping of an edge at a tip end portion, and when the scrapability has been lowered, an object to be removed remains on the photosensitive member and causes a streaky image failure.

In Japanese Patent Application Laid-Open No. 2001-75451, a cleaning blade is disclosed, the tip end portion of which is highly hardened by increasing a concentration of an isocyanurate group at the tip end portion of the cleaning blade formed of a polyurethane elastomer. It is attempted to thereby lower the friction between the photosensitive member and the cleaning blade, and to improve a cleaning failure due to wear of an edge.

In addition, in Japanese Patent Application Laid-Open No. 2012-53311, an attempt is made to suppress wear and chipping of an edge by optimizing the hardness of a tip end portion of a cleaning blade.

SUMMARY OF THE INVENTION

However, according to the investigation by the present inventors, it has been found that in Japanese Patent Application Laid-Open No. 2001-75451, edge wear is improved but a lowering of the scrapability is observed, which occurs due to local chipping of a blade under a low temperature and low humidity environment. In addition, it has been found that in Japanese Patent Application Laid-Open No. 2012-53311, the wear and chipping of the edge are improved, but a lowering of the scrapability is observed, which occurs due to settling (plastic deformation occurring due to prolonged contact with photosensitive member in a state in which blade rubber is deflected) under high temperature and high humidity.

Accordingly, an object of the present invention is to provide a process cartridge and an electrophotographic image forming apparatus which contribute to a stable formation of high-quality electrophotographic images, regardless of environments.

The present invention is a process cartridge configured to be detachably attachable to a main body of an electrophotographic image forming apparatus, wherein the process cartridge includes an electrophotographic photosensitive member and a cleaning member arranged in contact with the electrophotographic photosensitive member, wherein an elastic deformation modulus of a surface layer of the electrophotographic photosensitive member is 35% or larger, and the cleaning member is formed of a urethane foam layer, wherein a density of the urethane foam layer is 200 to 500 kg/cm$^3$, and a 25% compressive load of the urethane foam layer is 0.3 MPa or smaller.

According to the present invention, a process cartridge and an electrophotographic image forming apparatus can be provided which contribute to the stable formation of high-quality electrophotographic images, regardless of environments.

Further features of the present invention will become apparent from the following description of exemplary embodiments with reference to the attached drawing.

BRIEF DESCRIPTION OF THE DRAWINGS

FIGURE illustrates a view illustrating one example of a schematic configuration of an electrophotographic image forming apparatus provided with a process cartridge.

DESCRIPTION OF THE EMBODIMENTS

Preferred embodiments of the present invention will now be described in detail in accordance with the accompanying drawing.

The present invention is a process cartridge configured to be detachably attachable to a main body of an electrophotographic image forming apparatus, wherein the process cartridge includes an electrophotographic photosensitive member and a cleaning member arranged in contact with the electrophotographic photosensitive member, wherein an elastic deformation modulus of a surface layer of the electrophotographic photosensitive member is 35% or larger, and the cleaning member is formed of a urethane foam layer, wherein a density of the urethane foam layer is 200 to 500 kg/cm$^3$, and a 25% compressive load of the urethane foam layer is 0.3 MPa or smaller.

A cleaning failure originating in edge wear and flexure, which has occurred in a conventional rubber blade can be improved by employing the urethane foam layer as a cleaning member, which has a density of 200 to 500 kg/m$^3$ and a 25% compressive load of 0.3 MPa or smaller, in other words, has a high density and is soft, to clean a photosensitive member having an elastic deformation modulus equal to or larger than a certain value. It has been found that at this time, it is essential that the photosensitive member has an elastic deformation modulus equal to or larger than a certain value, and when the photosensitive member does not satisfy this condition, a sufficient effect is not obtained. It is assumed that the urethane foam layer acquires excellent cleaning characteristics because a toner layer is stably formed between the urethane foam layer and the photosensitive member, a low friction state is maintained, and the followability of the urethane foam layer to the photosensitive member becomes adequate, due to the surface of the photosensitive member having an elastic deformation modulus equal to or larger than a certain value.

The present invention will be described in detail below.

The cleaning member of the present invention is formed of the urethane foam layer.

The density of the above described urethane foam layer is 200 to 500 kg/m$^3$, is preferably 200 to 400 kg/m$^3$, and is more preferably 200 to 300 kg/m$^3$. When the density is 200 to 500 kg/m$^3$, the urethane foam layer can become a toner seal member excellent in sealing characteristics and slidability. In addition, when the density is smaller than 200 kg/m$^3$, sufficient sealing characteristics cannot be obtained.

On the other hand, when the density exceeds 500 kg/m$^3$, the flexibility of the urethane foam layer is lowered and becomes hard, and sufficient scrapability cannot be obtained. Incidentally, this density is a value which is measured according to JIS K 6401.

In addition, the 25% compressive load of the urethane foam layer is 0.3 MPa or smaller. If the 25% compressive load is larger than 0.3 MPa, sufficient flexibility cannot be secured, the followability of the urethane foam layer to the photosensitive member is aggravated, and thereby a concern of a cleaning failure occurs.

In addition, this 25% compressive load is a value which is measured according to JIS K 6254.

The urethane foam layer has a cell structure. The cell diameter is not limited in particular, but is preferably 350 μm or smaller, is more preferably 50 to 300 μm, is more preferably 50 to 200 μm, and is further preferably 50 to 100 μm.

In addition, when the cell diameter exceeds 350 μm, the cell diameters become easily scattered, and accordingly there is a concern that cleaning properties are aggravated due to toner leakage particularly under high temperatures and high humidities. Incidentally, the cell diameter is a value measured using a SEM photograph (electron photomicrograph).

The elastic deformation modulus of the surface layer of the electrophotographic photosensitive member in the process cartridge of the present invention is 35% or larger.

Measurement was carried out as follows.

The hardness of a groove was tested using a Vickers quadrangular pyramid diamond indenter under an environment of a temperature of 25° C. and a humidity of 50% RH, and the elastic deformation modulus at the time when the maximum indentation depth was 0.2 d (μm) was determined to be We (A) %. In other words, the elastic deformation modulus can be determined by a work amount (energy) which the indenter has exerted on an object to be measured (surface of electrophotographic photosensitive member), in other words, a change in energy based on an increase or decrease in a load which the indenter has exerted on the object to be measured (surface of electrophotographic photosensitive member). Specifically, the value (We/Wt) obtained by dividing the elastic deformation work amount We by the total work amount Wt is the elastic deformation modulus.

In the invention, the surface layer of the electrophotographic photosensitive member can include a charge transporting substance and a resin having a structure represented by general formula (II).

(II)

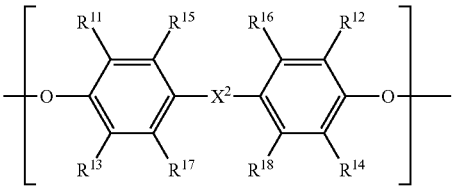

(In general formula (II), $X^2$ represents a single bond, an oxygen atom, a divalent alkylene group or a divalent cycloalkylene group. $R^{11}$ to $R^{18}$ each independently represent a hydrogen atom or an alkyl group.)

In the present invention, the surface layer of the above described electrophotographic photosensitive member can include a silica particle having a volume average particle diameter of 30 nm or larger and 400 nm or smaller.

In the present invention, it is preferable that the surface layer of the above described electrophotographic photosensitive member includes a charge transporting substance, and a resin having the structure represented by formula (II) and a structure represented by formula (I).

(I)

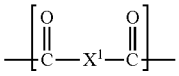

(In formula (I), $X^1$ represents a divalent group.)

In the present invention, it is preferable that the above described resin has a structure represented by formula (II-1) and a structure represented by formula (II-3), as the structure represented by formula (II).

(II-1)

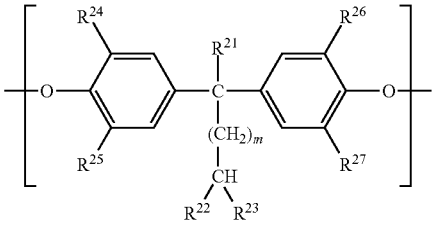

(In formula (II-1), $R^{21}$ represents a hydrogen atom, a methyl group, an ethyl group or a phenyl group. $R^{22}$ and $R^{23}$ each independently represent an alkyl group having 1 to 4 carbon atoms. $R^{24}$ to $R^{27}$ each independently represent a hydrogen atom or a methyl group. Suffix m represents the number of repetitions in the parenthesis and is an integer from 0 to 3.)

(II-3)

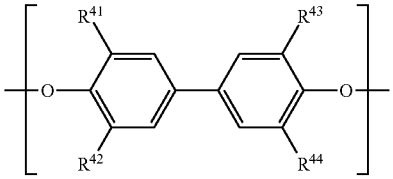

(In formula (II-3), $R^{41}$ to $R^{44}$ each independently represent a hydrogen atom or an alkyl group).

In the present invention, it is preferable that the above described resin includes a structure represented by formula (I-1) as the structure represented by the above described formula (I).

(I-1)

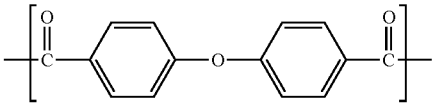

[Electrophotographic Photosensitive Member]

The electrophotographic photosensitive member of the present invention has a surface layer including a charge transporting substance. Furthermore, it is further preferable to have a support and a photosensitive layer. The photosensitive layer of the electrophotographic photosensitive member is mainly classified into (1) a laminate type photosensitive layer and (2) a single layer type photosensitive layer. (1) The laminate type photosensitive layer has a charge generating layer including a charge generating substance, and a charge transporting layer including a charge transporting substance. (2) The single layer type photosensitive layer is a photosensitive layer including both of the charge generating substance and the charge transporting substance. In the present invention, (1) in the case of the laminate type photosensitive layer, the surface layer including the charge transporting substance becomes the charge transporting layer, and (2) in the case of the single layer type photosensitive layer, the surface layer including the charge transporting substance becomes the photosensitive layer. Hereafter, the support and each of the layers will be described.

Examples of a method for producing the electrophotographic photosensitive member include a method of preparing a coating liquid for each of the layers which will be described later, coating the coating liquids in a desired order of the layers, and drying the coating liquids. At this time, examples of a coating method of the coating liquid include a dip coating method, a spray coating method, a curtain coating method and a spin coating method. Among the methods, the dip coating method is preferable from the viewpoint of efficiency and productivity.

<Support>

In the present invention, it is preferable that the electrophotographic photosensitive member has a support. The support is preferably an electroconductive support having electroconductivity. Examples of the electroconductive support include: supports formed from a metal such as aluminum, iron, nickel, copper and gold or an alloy thereof; and supports having a thin film of metal such as aluminum, chromium, silver and gold formed on an insulative support such as a polyester resin, a polycarbonate resin, a polyimide resin and glass, having a thin film of an electroconductive material such as indium oxide, tin oxide and zinc oxide formed on the insulative support, and having a thin film of electroconductive ink to which a silver nanowire is added formed on the insulative support.

The surface of the support may be subjected to electrochemical treatment such as anodic oxidation, wet honing treatment, blasting treatment, cutting treatment or the like, in order to improve the electric characteristics and suppress the interference fringes.

Examples of shapes of the support include a cylindrical shape, a belt shape and a film shape.

<Electroconductive Layer>

In the present invention, an electroconductive layer may be provided on the support. The average film thickness of the electroconductive layer is preferably 0.2 μm or more and 40 μm or less, is more preferably 1 μm or more and 35 μm or less, and is particularly preferably 5 μm or more and 30 μm or less.

It is preferable that the electroconductive layer includes a metal oxide particle and a binder resin. Examples of the metal oxide particle include a particle of zinc oxide, white lead, aluminum oxide, indium oxide, silicon oxide, zirconium oxide, tin oxide, titanium oxide, magnesium oxide, antimony oxide, bismuth oxide, indium oxide doped with tin, tin oxide doped with antimony and/or tantalum, and zirconium oxide. Among the metal oxides, particles of the zinc oxide, the titanium oxide and the tin oxide are preferable. The number average particle diameter of the metal oxide particles is preferably 30 to 450 nm, and more preferably is 30 to 250 nm, in order to suppress the generation of black spots due to that a local electroconductive path is formed.

Examples of the binder resin include a polyester resin, a polycarbonate resin, a polyvinyl butyral resin, an acrylic resin, a silicone resin, an epoxy resin, a melamine resin, a urethane resin, a phenol resin and an alkyd resin.

The electroconductive layer can be formed by preparing a coating liquid for an electroconductive layer and coating the coating liquid on the support. It is preferable that the coating liquid for the electroconductive layer include a solvent together with a metal oxide particle and a binder resin. Examples of such solvents include an alcohol-based solvent, a sulfoxide-based solvent, a ketone-based solvent, an ether-based solvent, an ester-based solvent and an aromatic hydrocarbon solvent. Examples of a dispersion method for dispersing the metal oxide particle in the coating liquid for the electroconductive layer include methods using a paint shaker, a sand mill, a ball mill, and a liquid collision type high-speed dispersing machine. In addition, in order to improve the dispersibility of the metal oxide particle, the surface of the metal oxide particle may be treated with a silane coupling agent or the like. Furthermore, in order to control the resistance of the electroconductive layer, the metal oxide particle may be doped with another metal or metal oxide.

<Undercoat Layer>

In the present invention, an undercoat layer may be provided on the support or the electroconductive layer. By the undercoat layer being provided, the barrier function and the adhesion function are enhanced. The average film thickness of the undercoat layer is preferably 0.05 μm or more and 40 μm or less, is more preferably 0.05 μm or more and 7 μm or less, and is particularly preferably 0.1 μm or more and 2 μm or less.

It is preferable that the undercoat layer includes an electron transporting substance and a binder resin, in order to prevent the electric charges generated in the charge generating layer from staying there. Due to this structure, electrons among the electric charges generated in the charge generating layer can be transported to the support, and accordingly an inactivation of the electric charges and an increase in traps in the charge generating layer can be suppressed even if the charge transport capability of the charge transporting layer has been improved. Therefore, initial electric characteristics and electric characteristics during repeated use are improved.

Examples of the electron transporting substance include a quinone compound, an imide compound, a benzimidazole compound, a cyclopentadienylidene compound, a fluorenone compound, a xanthone-based compound, a benzophenone-based compound, a cyanovinyl-based compound, a naphthalimide compound and a peryleneimide compound. It is preferable that the electron transporting substance has a polymerizable functional group such as a hydroxy group, a thiol group, an amino group, a carboxyl group and a methoxy group.

Examples of the binder resin include polyacrylic acids, methylcellulose, ethylcellulose, a polyamide resin, a polyimide resin, a polyamide-imide resin, a polyamide acid resin, a urethane resin, a melamine resin and an epoxy resin. In addition, the binder resin may be a polymer having a crosslinked structure formed by thermal polymerization (curing) of a thermoplastic resin having a polymerizable functional group such as an acetal resin and an alkyd resin, and a monomer having a polymerizable functional group such as an isocyanate compound.

The undercoat layer is obtained by the operation of forming a coating film of a coating liquid for the undercoat layer, including a binder resin, and drying the coating film.

<Photosensitive Layer>

(1) Laminate Type Photosensitive Layer

In the case of the laminate type photosensitive layer, the electrophotographic photosensitive member has a charge generating layer including a charge generating substance, a charge transporting substance, and a charge transporting layer including a polyester resin having the structure represented by general formula (I) and the structure represented by general formula (II).

(1-1) Charge Generating Layer

The average film thickness of the charge generating layer is preferably 0.05 m or more and 5 μm or less, is more preferably 0.05 μm or more and 1 μm or less, and is particularly preferably 0.1 μm or more and 0.3 μm or less.

Examples of the charge generating substance include an azo pigment, a perylene pigment, an anthraquinone derivative, an anthanthrone derivative, a dibenzopyrenequinone derivative, a pyranthrone derivative, a violanthrone derivative, an isoviolanthrone derivative, an indigo derivative, a thioindigo derivative, a phthalocyanine pigment and a bisbenzimidazole derivative. Among the above compounds, the azo pigment or the phthalocyanine pigment is preferable. Among the phthalocyanine pigment, oxytitanium phthalocyanine, chlorogallium phthalocyanine and hydroxygallium phthalocyanine are preferable.

Examples of the binder resin which is used in the charge generating layer include: polymers and copolymers of vinyl compounds such as styrene, vinyl acetate, vinyl chloride, acrylic acid ester, methacrylic acid ester, vinylidene fluoride and trifluoroethylene; and a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin and an epoxy resin. Among the above compounds, the polyester resin, the polycarbonate resin and the polyvinyl acetal resin are preferable, and in particular, the polyvinyl acetal resin is more preferable.

The content of the charge generating substance in the charge generating layer is preferably 30 mass % or more and 90 mass % or less, and is more preferably 50 mass % or more and 80 mass % or less, with respect to the total mass of the charge generating layer.

In the charge generating layer, a mass ratio (charge generating substance/binder resin) of the charge generating substance to the binder resin is preferably in a range of 10/1 to 1/10, and is more preferably in a range of 5/1 to 1/5.

The charge generating layer can be formed by forming a coating film of a coating liquid for the charge generating layer, which has been prepared by mixing the charge generating substance and the binder resin in a solvent, and drying the coating film. Examples of the solvents to be used for the coating liquid for the charge generating layer include an alcohol-based solvent, a sulfoxide-based solvent, a ketone-based solvent, an ether-based solvent, an ester-based solvent and an aromatic hydrocarbon solvent.

(1-2) Charge Transporting Layer

A film thickness of the charge transporting layer is preferably 5 μm or more and 50 μm or less, and is more preferably 10 μm or more and 35 μm or less.

Examples of the charge transporting substance include a polycyclic aromatic compound, a heterocyclic compound, a hydrazone compound, a styryl compound, an enamine compound, a benzidine compound, a triarylamine compound and triphenylamine. In addition, the examples of the charge transporting substance also include a polymer having a group derived from the above compounds in a main chain or a side chain. Among the substances, the triarylamine compound or the benzidine compound is preferable from the viewpoint of potential stability during repeated use. In addition, a plurality of types of charge transporting substances may be contained together. Specific examples of the charge transporting substance are illustrated below.

(CTM-1)

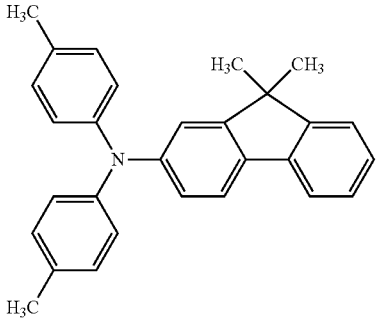

(CTM-2)

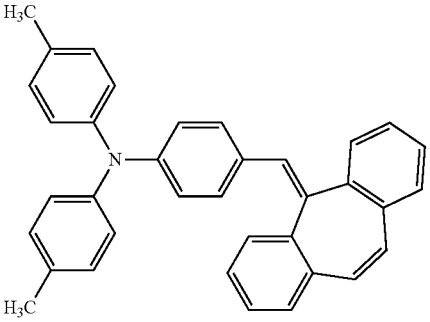

(CTM-3)

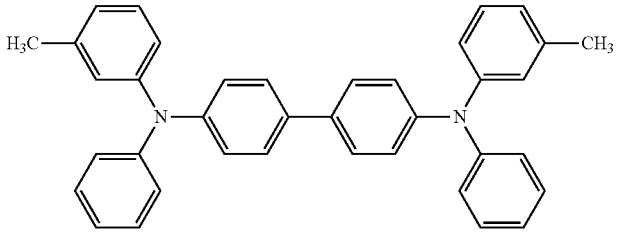

-continued
(CTM-4)
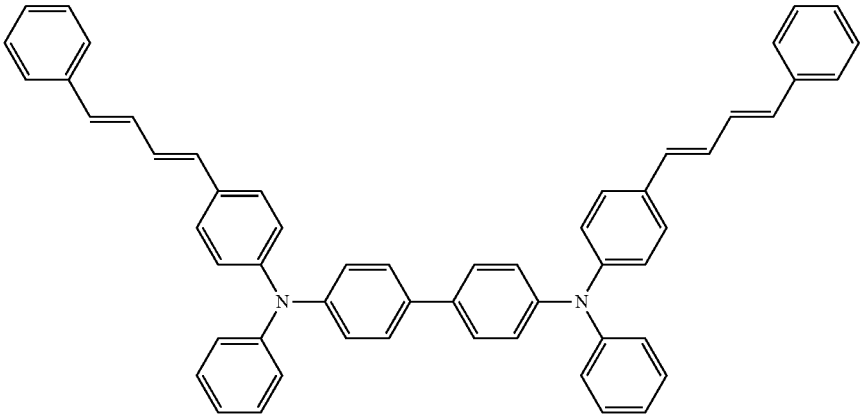
(CTM-5)
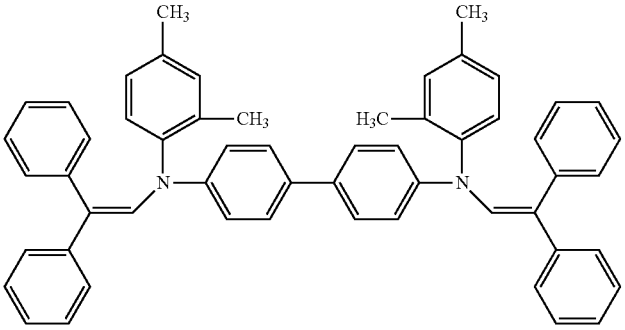
(CTM-6)
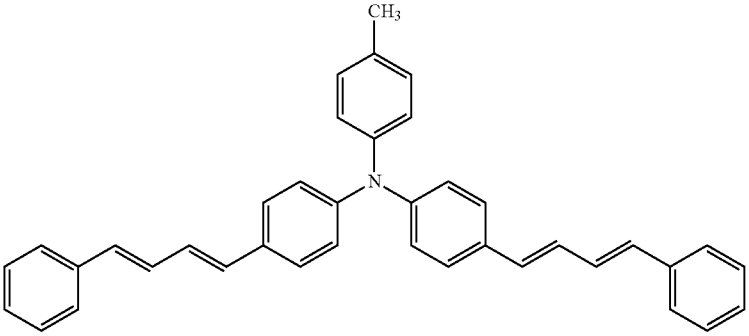

-continued (CTM-7)

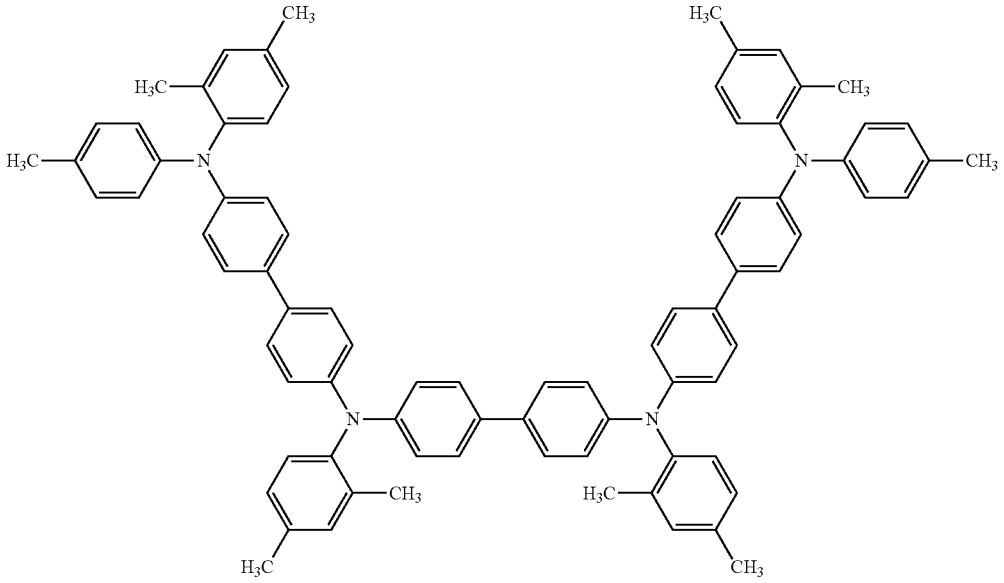

(CTM-8)

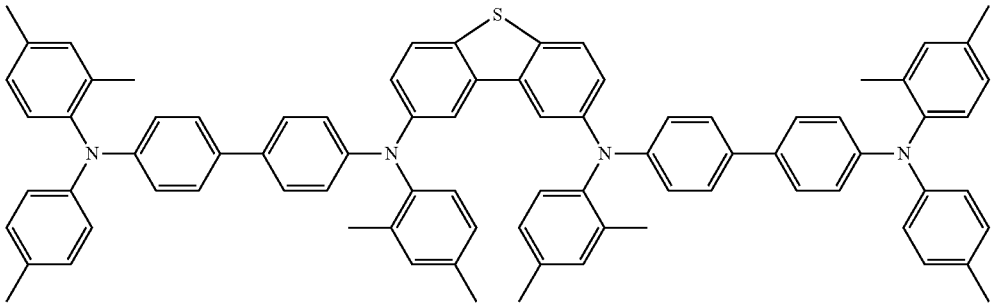

(CTM-9)

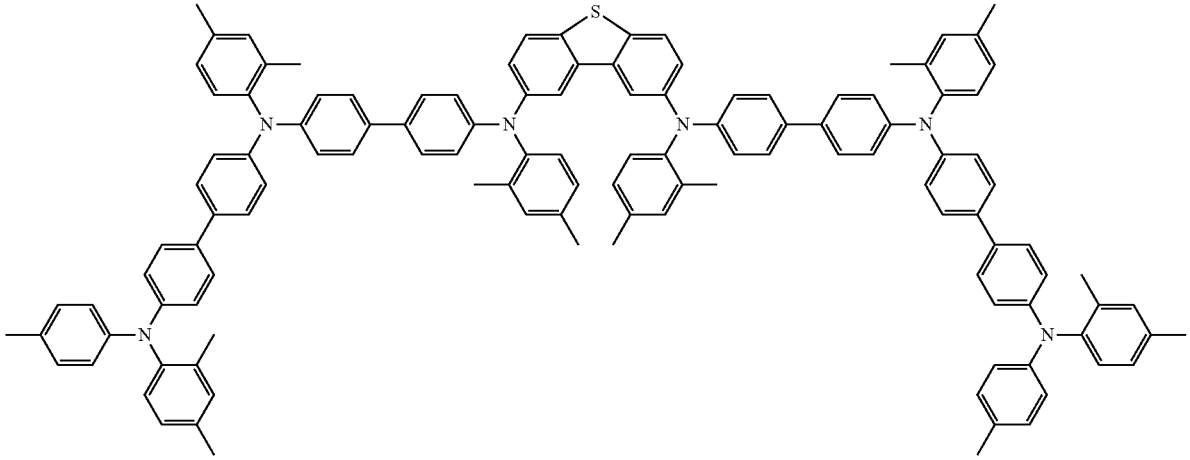

Examples of the binder resin to be used for the charge transporting layer include polyester, an acrylic resin, a phenoxy resin, polycarbonate, polystyrene, polyvinyl acetate, polysulfone, polyarylate, vinylidene chloride and an acrylonitrile copolymer. Among the above binder resins, the polycarbonate and the polyarylate are preferable.

The content of the charge transporting substance in the charge transporting layer is preferably 20 mass % or more and 80 mass % or less, and is more preferably 30 mass % or more and 60 mass % or less, with respect to the total mass of the charge transporting layer.

The charge transporting layer can be formed by forming a coating film of the coating liquid for the charge transporting layer, which has been prepared by dissolving the charge transporting substance and the binder resin in a solvent, and drying the coating film. Examples of the solvent to be used for the coating liquid for forming the charge transporting layer include an alcohol-based solvent, a sulfoxide-based solvent, a ketone-based solvent, an ether-based solvent, an ester-based solvent and an aromatic hydrocarbon solvent.

(2) Single Layer Type Photosensitive Layer

In the case of a single layer type photosensitive layer, the photosensitive layer includes a charge generating substance, a charge transporting substance, and a polyester resin having the structure represented by general formula (I) and the structure represented by general formula (II). The photosensitive layer can be formed by the operation of forming a coating film of a coating liquid for the photosensitive layer, which has been prepared by mixing a charge generating substance, a charge transporting substance and a binder resin in a solvent, and of drying the coating film. Examples of the charge transporting substance and the binder resin are similar to materials listed as examples in the above described "(1) laminate type photosensitive layer".

[Process Cartridge and Electrophotographic Image Forming Apparatus]

A process cartridge of the present invention includes: integrally supporting the electrophotographic photosensitive member described above, and at least one unit selected from the group consisting of a charging unit, a developing unit, a transfer unit and a cleaning unit; and being freely detachable to a main body of the electrophotographic image forming apparatus.

In addition, the electrophotographic image forming apparatus of the present invention includes: the electrophotographic photosensitive member described above, the charging unit, the exposing unit, the developing unit and the transfer unit.

FIGURE illustrates one example of a schematic configuration of the electrophotographic image forming apparatus having the process cartridge provided with the electrophotographic photosensitive member.

In FIGURE, a cylindrical electrophotographic photosensitive member 1 is rotationally driven around a shaft 2 in the direction of the arrow at a predetermined peripheral speed. The surface (peripheral surface) of the electrophotographic photosensitive member 1 which is rotationally driven is uniformly charged to a predetermined positive or negative potential by a charging unit 3 (primary charging unit: charging roller or the like). Subsequently, the surface is exposed to light (image exposure) 4 from an exposure unit (not illustrated) such as slit exposure and laser beam scanning exposure. Thus, electrostatic latent images corresponding to target images are sequentially formed on the surface of the electrophotographic photosensitive member 1.

The electrostatic latent image formed on the surface of the electrophotographic photosensitive member 1 is subsequently developed by a toner included in a developing agent in a developing unit 5 to form a toner image on the electrophotographic photosensitive member 1. Subsequently, the toner image on the surface of the electrophotographic photosensitive member 1 is sequentially transferred onto a transfer material (paper or the like) P by a transfer bias given by a transfer unit (transfer roller or the like) 6. The toner image on the surface of the electrophotographic photosensitive member 1 may be transferred to the transfer material (paper or the like) via an intermediate transfer member. Incidentally, the transfer material P is taken out from a transfer material supply unit (not illustrated) to a gap between the electrophotographic photosensitive member 1 and the transfer unit 6 (contact portion), in synchronization with the rotation of the electrophotographic photosensitive member 1, and is fed.

The transfer material P onto which the toner image has been transferred is separated from the surface of the electrophotographic photosensitive member 1, and is introduced into a fixing unit 8. The toner image is fixed there, and thereby the image formed product (print and copy) is discharged to the outside of the apparatus.

As for the surface of the electrophotographic photosensitive member 1 after the toner image has been transferred, the developing agent (toner) remaining after the transfer is removed from the surface of the electrophotographic photosensitive member 1 by the cleaning unit (cleaning member) 7. Subsequently, the surface is subjected to static elimination processing by pre-exposure light (not illustrated) emitted from a pre-exposure unit (not illustrated), and then, is repeatedly used for the image forming. Incidentally, as illustrated in FIGURE, in the case where the charging unit 3 is a contact charging unit such as a charging roller, the pre-exposure is not necessarily required.

In the above described, among the components of the electrophotographic photosensitive member 1, the charging unit 3, the developing unit 5, the transfer unit 6 and the cleaning unit 7 and the like, a plurality of components may be selected, stored in a container, and integrally combined and structured as a process cartridge. The process cartridge may be structured so as to be freely detachable against the main body of the electrophotographic image forming apparatus such as a copying machine or a laser beam printer. In FIGURE, the electrophotographic photosensitive member 1, the charging unit 3, the developing unit 5 and the cleaning unit 7 are integrally supported to form a cartridge. The process cartridge 9 is formed so as to be freely detachable to the main body of the electrophotographic image forming apparatus, with the use of a guide unit 10 such as a rail of the main body of the electrophotographic image forming apparatus.

EXAMPLES

The present invention will be described in more detail with reference to Examples and Comparative Examples. The present invention is not limited by the following examples as long as the present invention does not depart from the gist thereof. Incidentally, "part(s)" in the description of the following Examples is on a mass basis unless otherwise particularly noted.

<Production of Urethane Foam Layer>

[1] Used Raw Material (1) Polyol: Polyether-based polyol (made by Sanyo Chemical Industries, Ltd., trade name "GP-3000", number average molecular weight: 3000, number of functional groups: 3, and hydroxyl value: 56 mg KOH/mg)

(2) Isocyanate: crude MDI (made by Nippon Polyurethane Industry Co., Ltd., trade name "Coronate 1130", and NCO %: 31%)

(3) Chain extender: 1,4-butanediol (4) Catalyzer: stannous octoate (made by Johoku Chemical Co., Ltd.)

(5) Foam stabilizer: silicone-based foam stabilizer (made by MOMENTIVE, and trade name "L-5614")

(6) Thickening agent: aluminum hydroxide (made by Showadenkosha Co., Ltd, and trade name "Heidilite H-10")

Isocyanate and a gas for foaming (nitrogen gas, supply amount: 0.1 $m^3$N/min) were supplied to a mixture of 100 parts of the polyol, 4 parts of the chain extender, 20 parts of the thickening agent, 0.1 part of the catalyzer and 4 parts of the foam stabilizer, the resultant mixture was mixed and sheared, and a raw material for the urethane foam was prepared. Incidentally, the above described isocyanate was blended so that an isocyanate index (NCO Index) became 90 to 110, which was determined when the polyol composition and the isocyanate component were mixed and reacted. Here, the isocyanate index means such an index that an equivalent ratio of isocyanate groups in a (poly)isocyanate component to all active hydrogen groups included in the polyol composition is shown by percentage (equivalent ratio of isocyanate group to 100 equivalents of active hydrogen group).

Next, the above described raw material of the urethane foam was supplied from a discharge nozzle, and was heated to 150° C. The foam raw material was reacted and cured, and thereby urethane foam layers 1 to 9 (thickness: 5 mm) shown in Table 1 were obtained.

TABLE 1

| | Density ($kg/m^3$) | 25% Compressive load (MPa) | Cell diameter (μm) |
|---|---|---|---|
| Urethane foam layer 1 | 240 | 0.04 | 450 |
| Urethane foam layer 2 | 240 | 0.04 | 350 |
| Urethane foam layer 3 | 240 | 0.04 | 50 |
| Urethane foam layer 4 | 320 | 0.08 | 100 |
| Urethane foam layer 5 | 480 | 0.25 | 100 |
| Urethane foam layer 6 | 240 | 0.008 | 50 |
| Urethane foam layer 7 | 530 | 0.21 | 100 |
| Urethane foam layer 8 | 150 | 0.04 | 100 |
| Urethane foam layer 9 | 480 | 0.39 | 100 |

<Production of Electrophotographic Photosensitive Member>

(Method of Producing Photosensitive Member 1)

An aluminum cylinder having a diameter of 24 mm and a length of 257 mm was used as a support (electroconductive support).

Next, 214 parts of a titanium oxide ($TiO_2$) particle which was coated with oxygen-deficient tin oxide ($SnO_2$) and was used as a metal oxide particle, 132 parts of a phenolic resin (monomer/oligomer of phenolic resin) (product name: Plyophen J-325, made by DIC Corporation, and resin solid content: 60 mass %) which was used as a binder material, and 98 parts of 1-methoxy-2-propanol which was used as a solvent was charged in a sand mill which used 450 parts of glass beads having a diameter of 0.8 mm; the mixture was subjected to dispersion treatment under conditions that the number of rotations was 2000 rpm, a dispersion treatment time period was 4.5 hours, a set temperature of the cooling water was 18° C.; and a dispersion liquid was obtained. The glass beads were removed from this dispersion liquid by a mesh (aperture: 150 μm).

A silicone resin particle of Tospearl 120 (made by Momentive Performance Materials Japan KK, and average particle size of 2 μm) was added to the dispersion liquid, as a surface roughness providing material. An amount of the silicone resin particle added at this time was set at 10 mass % with respect to the total mass of the metal oxide particles and the binding material in the dispersion liquid after the glass beads were removed. In addition, silicone oil of SH28PA (made by Dow Corning Toray Co., Ltd.) was added to the dispersion liquid as a leveling agent so as to become 0.01 mass % with respect to the total mass of the metal oxide particles and the binding material in the dispersion liquid; the resultant mixture was stirred; and thereby a coating liquid for an electroconductive layer was prepared.

This coating liquid for the electroconductive layer was dip-coated on the above described support; the obtained coating film was dried at 150° C. for 30 minutes to be thermally cured; and the electroconductive layer was formed which had a film thickness of 30 μm.

Next, 15 parts of an N-methoxymethylated 6-nylon resin of Toresin EF-30T (made by Nagase ChemteX Corporation) and 5 parts of copolymerized nylon resin of Amilan CM 8000 (made by Toray Industries, Inc.) were dissolved in a mixed solvent of 220 parts of methanol and 110 parts of 1-butanol, and a coating liquid for an undercoat layer was prepared. The coating liquid for the undercoat layer was dip-coated on the electroconductive layer to form a coating film; the obtained coating film was dried at a temperature of 100° C. for 10 minutes; and the undercoat layer was formed which had a film thickness of 0.65 μm.

Next, 2 parts of polyvinyl butyral (trade name: S-LEC BX-1, made by Sekisui Chemical Co., Ltd.) was dissolved in 100 parts of cyclohexanone. To this solution, 4 parts of hydroxygallium phthalocyanine crystal (charge generating substance) was added, which were crystalline having strong peaks at 7.4° and 28.1° that are Bragg angles 2θ±0.2° in CuKα characteristic X-ray diffraction. The mixture was charged into a sand mill which used glass beads having a diameter of 1 mm, and was subjected to dispersion treatment for 1 hour under an atmosphere of 23±3° C. After the dispersion treatment, 100 parts of ethyl acetate was added to the dispersion, and a coating liquid for a charge generating layer was prepared. The coating liquid for the charge generating layer was dip-coated on the above described undercoat layer, and the obtained coating film was dried at 90° C. for 10 minutes to form a charge generating layer having a film thickness of 0.20 μm.

Next, 8 parts of a compound (charge transporting substance) represented by formula (CTM-7) and 10 parts of a resin of a formula (101) were dissolved in a mixed solution of 33 parts of dimethoxymethane and 49 parts of cyclopentanone, and a coating liquid for a charge transporting layer was prepared.

(101)

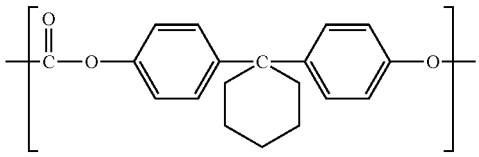

The coating liquid for the charge transporting layer was dip-coated on the above described charge generating layer to form a coating film, and the obtained coating film was dried at 130° C. for 30 minutes to form the charge transporting layer (surface layer) having a film thickness of 23 μm.

In this way, a photosensitive member 1 was produced which had the support, the electroconductive layer, the undercoat layer, the charge generating layer and the charge transporting layer in this order.

(Method of Producing Photosensitive Member 2)

In the production method for the photosensitive member 1, a photosensitive member 2 was produced by a similar production method to that for the photosensitive member 1, except that the resin represented by formula (101) was changed to a resin represented by the following formula (102).

(102)

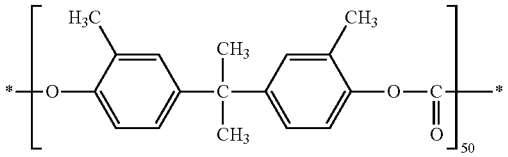

-continued

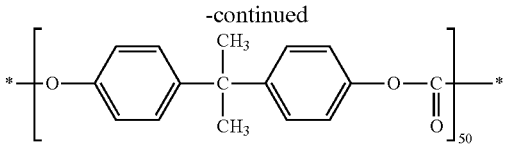

(Method of Producing Photosensitive Member 3)

In the production method for the photosensitive member 1, a photosensitive member 3 was produced by a similar production method to that for the photosensitive member 1, except that the resin represented by formula (101) was changed to a resin represented by the following formula (103).

(103)

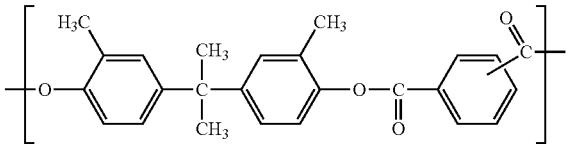

(Method of Producing Photosensitive Member 4)

In the production method for the photosensitive member 1, a photosensitive member 4 was produced by a similar production method to that for the photosensitive member 1, except that the resin represented by formula (101) was changed to a resin represented by the following formula (104).

(104)

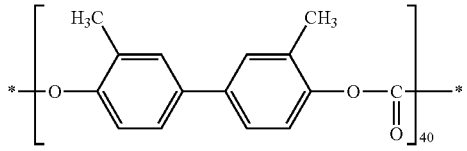

-continued

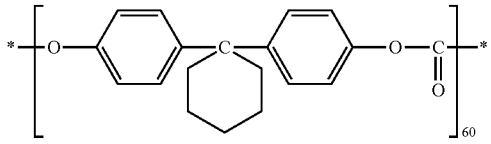

(Method of Producing Photosensitive Member 5)

In the production method for the photosensitive member 1, a photosensitive member 5 was produced by a similar production method to that for the photosensitive member 1, except that the resin represented by formula (101) was changed to a resin represented by the following formula (105).

(105)

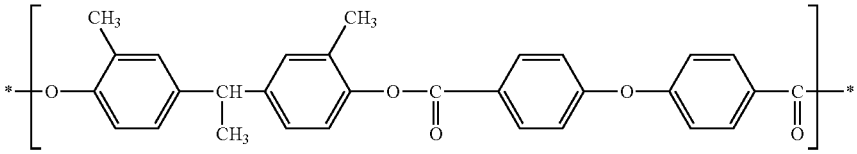

(Method of Producing Photosensitive Member 6)

In the production method for the photosensitive member 1, a photosensitive member 6 was produced by a similar production method to that for the photosensitive member 1, except that the resin represented by formula (101) was changed to a resin represented by the following formula (106).

(106)

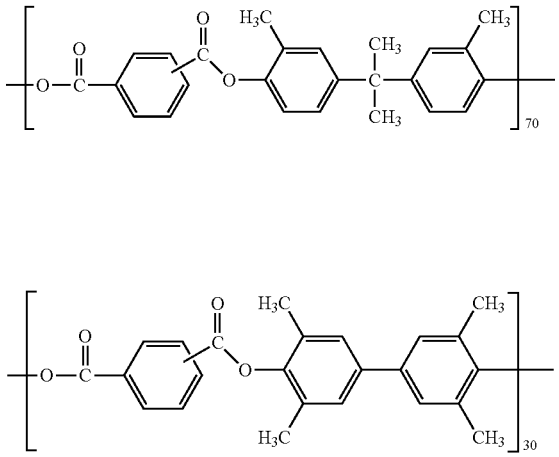

(Method of Producing Photosensitive Member 7)

In the production method for the photosensitive member 1, a photosensitive member 7 was produced by a similar production method to that for the photosensitive member 1, except that the resin represented by formula (101) was changed to a resin represented by the following formula (107).

(107)

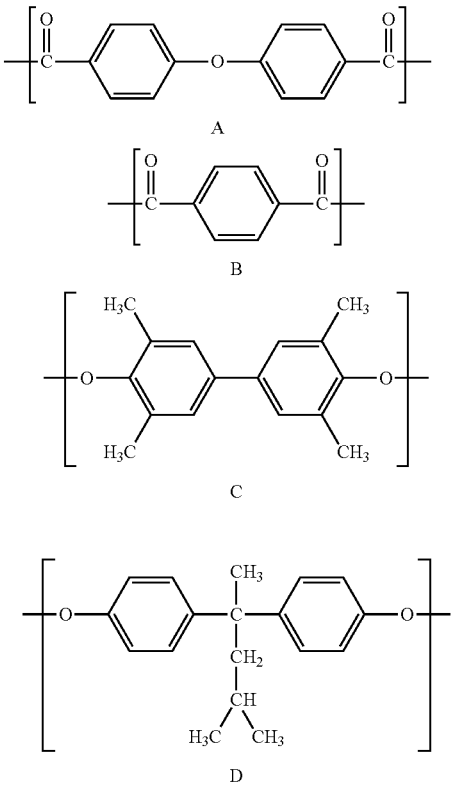

(Ratio of structure A to structure B is 7:3, and ratio of structure C to structure D is 5:5)

(Method of Producing Photosensitive Member 8)

A photosensitive member 8 was produced similarly to the production method for the photosensitive member 7, in regard to processes up to the charge generating layer.

To a solution of 9 parts of cyclopentanone, 1 part of a silica particle (trade name: RX 50, made by Nippon Aerosil Co., Ltd.) was added, the mixture was dispersed for 2 hours with the use of an ultrasonic disperser, and 10 parts of a silica dispersion liquid was obtained.

Next, 8 parts of a compound (charge transporting substance) represented by formula (CTM-7) and 10 parts of general formula (7) were dissolved in a mixed solution of 40 parts of dimethoxymethane and 50 parts of cyclopentanone; 10 parts of a silica dispersion liquid were added to the resultant solution; and a coating liquid for a charge transporting layer was prepared.

The coating liquid for the charge transporting layer was dip-coated on the charge generating layer, the obtained coating film was dried at 125° C. for 40 minutes to form the charge transporting layer having a film thickness of 22 μm, and a photosensitive member 8 was obtained.

(Method of Producing Photosensitive Member 9)

In the production method for the photosensitive member 1, a photosensitive member 9 was produced by a similar production method to that for the photosensitive member 1, except that the resin represented by general formula (101) was changed to a resin represented by the following general formula (109).

(109)

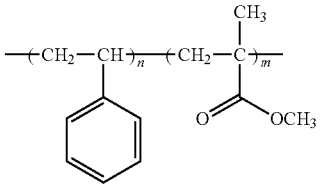

<Measurement of Elastic Deformation Modulus>

The elastic deformation moduli of the photosensitive members 1 to 9 were measured according to the above described measuring method. The obtained measured values are shown in Table 2.

TABLE 2

| | Resin | Elastic deformation modulus (%) |
|---|---|---|
| Photosensitive member 1 | General formula (101) | 37.5 |
| Photosensitive member 2 | General formula (102) | 35.4 |
| Photosensitive member 3 | General formula (103) | 43.5 |
| Photosensitive member 4 | General formula (104) | 39.5 |
| Photosensitive member 5 | General formula (105) | 42.9 |
| Photosensitive member 6 | General formula (106) | 44.8 |
| Photosensitive member 7 | General formula (107) | 43.4 |
| Photosensitive member 8 | General formula (108) | 46.5 |
| Photosensitive member 9 | General formula (109) | 33.8 |

Example 1

A process cartridge that included the photosensitive member 1 which was produced in the photosensitive member production example 1 described above and the urethane foam layer 1 which was used as a cleaning member was subjected to durability evaluation according to the following evaluation method, and the images were evaluated. The results are shown in Table 3.

[Evaluation]

A laser printer (Color Lase Jet Enterprise M552 remodeled machine) made by Hewlett-Packard Company (33 sheets per minute machine) was used as an evaluation apparatus. Evaluation was carried out in an environment of a temperature of 15° C. and a humidity of 10% RH, and in an environment of a temperature of 30° C. and a humidity of 80%. Images were output in an intermittent mode in which the output was stopped once every time one sheet of image was output, with the use of A4 size plain paper, and an image after 10,000 sheets of images were output was evaluated according to the following criteria.

Determination by the presence or absence of a black streak due to slipping through, on a solid white image in an initial stage (before output of 10,000 sheets)

AA: No occurrence of the black streak

A: Slight slipping through partially occurs though being within an allowable range on the image B: Slight slipping through occurs on the whole region on the image though being within an allowable range on the image.

C: Black streak, which is out of the allowable range, present on the image

Determination by the presence or absence of the black streak due to slipping through, on a solid white image after the durability test (after output of 10,000 sheets)

AA: No occurrence of the black streak

A: Slight slipping through partially occurs though being within an allowable range on the image B: Slight slipping through occurs on the whole region on the image though being within an allowable range on the image C: Black streak, which is out of the allowable range, present on the image Examples 2 to 13

Process cartridges that included the photosensitive members and the urethane foam layers shown in Table 3, which were used as a cleaning member, were subjected to the durability evaluation similarly to that in Example 1, and the images were evaluated. The obtained results are shown in Table 3.

TABLE 3

| | | | Image evaluation (15° C. and 10%) | | Image evaluation (30° C. and 80%) | |
|---|---|---|---|---|---|---|
| | Photosensitive member | Cleaning member | Initial | After 10k | Initial | After 10k |
| Example 1 | Photosensitive member 1 | Urethane foam 1 | AA | A | AA | B |
| Example 2 | Photosensitive member 1 | Urethane foam 2 | AA | A | AA | A |
| Example 3 | Photosensitive member 1 | Urethane foam 3 | AA | A | AA | A |
| Example 4 | Photosensitive member 1 | Urethane foam 4 | AA | A | AA | A |
| Example 5 | Photosensitive member 1 | Urethane foam 5 | AA | A | AA | A |
| Example 6 | Photosensitive member 1 | Urethane foam 6 | AA | A | AA | A |
| Example 7 | Photosensitive member 2 | Urethane foam 2 | AA | A | AA | A |
| Example 8 | Photosensitive member 3 | Urethane foam 2 | AA | A | AA | A |
| Example 9 | Photosensitive member 4 | Urethane foam 2 | AA | A | AA | A |
| Example 10 | Photosensitive member 5 | Urethane foam 2 | AA | A | AA | A |
| Example 11 | Photosensitive member 6 | Urethane foam 2 | AA | A | AA | A |
| Example 12 | Photosensitive member 7 | Urethane foam 2 | AA | AA | AA | A |
| Example 13 | Photosensitive member 8 | Urethane foam 2 | AA | AA | AA | AA |

Comparative Examples 1 to 4

Similarly to Example 1, similar evaluations were carried out with the use of the photosensitive members and the urethane foam layers shown in Table 4. The obtained results are shown in Table 4.

TABLE 4

| | | | Image evaluation (15° C. and 10%) | | Image evaluation (30° C. and 80%) | |
|---|---|---|---|---|---|---|
| | Photosensitive member | Cleaning member | Initial | After 10k | Initial | After 10k |
| Comparative Example 1 | Photosensitive member 1 | Urethane foam 7 | A | C | A | B |
| Comparative Example 2 | Photosensitive member 1 | Urethane foam 8 | C | B | C | C |

TABLE 4-continued

| | | | Image evaluation (15° C. and 10%) | | Image evaluation (30° C. and 80%) | |
|---|---|---|---|---|---|---|
| | Photosensitive member | Cleaning member | Initial | After 10k | Initial | After 10k |
| Comparative Example 3 | Photosensitive member 1 | Urethane foam 9 | A | B | A | C |
| Comparative Example 4 | Photosensitive member 9 | Urethane foam 1 | C | C | C | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-226186, filed Nov. 24, 2017, which is hereby incorporated by reference herein in its entirety.

What is claimed is:

1. A process cartridge configured to be detachably attachable to a main body of an electrophotographic image forming apparatus, the process cartridge comprising:

an electrophotographic photosensitive member and a cleaning member arranged in contact with the electrophotographic photosensitive member, wherein an elastic deformation modulus of a surface layer of the electrophotographic photosensitive member is 35% or larger, and the cleaning member is formed of a urethane foam, said urethane foam having a density of 200 to 500 kg/m$^3$ and a 25% compressive load of 0.3 MPa or smaller.

2. The process cartridge according to claim 1, wherein the urethane foam comprises a cell structure with a cell diameter of 350 μm or smaller.

3. The process cartridge according to claim 1, wherein the surface layer of the electrophotographic photosensitive member comprises a charge transporting substance and a resin having a structure represented by formula (II)

(II)

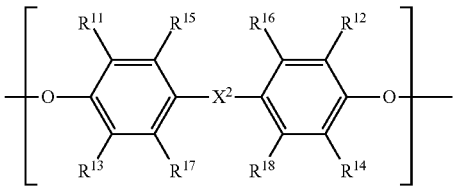

where $X^2$ represents a single bond, an oxygen atom, a divalent alkylene group or a divalent cycloalkylene group, and $R^{11}$ to $R^{18}$ independently represent a hydrogen atom or an alkyl group.

4. The process cartridge according to claim 1, wherein the surface layer of the electrophotographic photosensitive member comprises a charge transporting substance and a resin having a structure represented by formula (I) and a structure represented by formula (II)

(I)

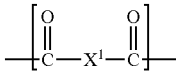

where $X^1$ represents a divalent group; and (II)

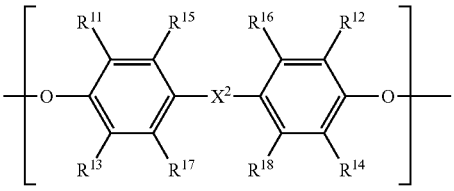

where $X^2$ represents a single bond, an oxygen atom, a divalent alkylene group or a divalent cycloalkylene group, and $R^{11}$ to $R^{18}$ independently represent a hydrogen atom or an alkyl group.

5. The process cartridge according to claim 4, wherein the structure represented by formula (II) comprises a structure represented by formula (II-1) and a structure represented by formula (II-3)

(II-1)

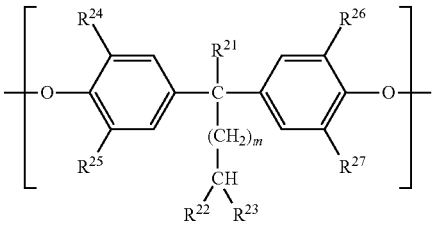

where $R^{21}$ represents a hydrogen atom, a methyl group, an ethyl group or a phenyl group, $R^{22}$ and $R^{23}$ independently represent an alkyl group having 1 to 4 carbon atoms, $R^{24}$ to $R^{27}$ independently represent a hydrogen atom or a methyl group, and m is an integer from 0 to 3; and (II-3)

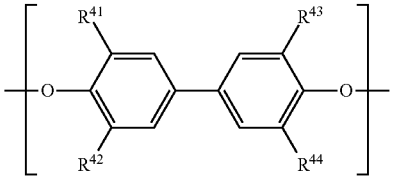

where $R^{41}$ to $R^{44}$ independently represent a hydrogen atom or an alkyl group.

6. The process cartridge according to claim 4, wherein the structure represented by formula (I) has a structure represented by formula (I-1)

(I-1)

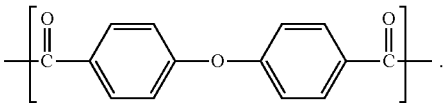

.

7. The process cartridge according to claim 4, wherein the surface layer of the electrophotographic photosensitive member further comprises a silica particle having a volume average particle diameter of 30 to 400 nm.

8. An electrophotographic image forming apparatus having a process cartridge configured to be detachably attachable to a main body of the electrophotographic image forming apparatus, said process cartridge comprising an electrophotographic photosensitive member and a cleaning member arranged in contact with the electrophotographic photosensitive member, wherein an elastic deformation modulus of a surface layer of the electrophotographic photosensitive member is 35% or larger, and the cleaning member is formed of a urethane foam, said urethane foam having a density of 200 to 500 kg/$m^3$ and a 25% compressive load of 0.3 MPa or smaller.

* * * * *